US005114284A

United States Patent [19]

Keizer et al.

[11] Patent Number: 5,114,284

[45] Date of Patent: May 19, 1992

[54] HEATER FOR ASPHALT PAVEMENT OR THE LIKE

[76] Inventors: Gregory J. Keizer, 2105 McKail Rd., Leonard, Mich. 48038; Carl W. Morris, 5181 Crawford Rd., Dryden, Mich. 48428

[21] Appl. No.: 629,092

[22] Filed: Dec. 17, 1990

Related U.S. Application Data

[60] Continuation of Ser. No. 155,966, Feb. 16, 1988, abandoned, which is a division of Ser. No. 860,847, May 8, 1988, abandoned.

[51] Int. Cl.[5] ..... E01C 23/14; F24H 1/00; F23C 5/00

[52] U.S. Cl. ..... 404/95; 431/328; 432/222

[58] Field of Search ..... 404/95, 96; 431/328; 432/222; 126/271.2, 271.24

[56] References Cited

U.S. PATENT DOCUMENTS

| | | | |
|---|---|---|---|
| 3,055,280 | 9/1962 | Neville | 404/95 |
| 3,087,041 | 4/1963 | Vonk | 431/428 X |
| 4,070,146 | 1/1978 | Straitz, III | 431/202 |
| 4,189,297 | 2/1980 | Bratko et al. | 431/428 |
| 4,435,154 | 3/1984 | Vigneau | 431/328 |
| 4,601,605 | 7/1986 | Damp et al. | 404/95 |

*Primary Examiner*—Ramon S. Britts
*Assistant Examiner*—Nancy P. Connolly
*Attorney, Agent, or Firm*—Gifford, Groh, Sprinkle, Patmore and Anderson

[57] ABSTRACT

A lightweight surface heater suitable for repairing asphalt pavement, or the like, which conveniently folds for trailering. Air and gaseous fuel are mixed and forced down through refractory blanket to burn on its lower surface radiating heat to the roadway. A hinged middle allows one half of the heater, with trailer tongue and tires attached to its top, to be folded upside down underneath the other half during transport.

9 Claims, 1 Drawing Sheet

HEATER FOR ASPHALT PAVEMENT OR THE LIKE

This is a continuation of copending application Ser. No. 07/155,966 filed on Feb. 16, 1988, which is a divisional of application Ser. No. 860,847 filed May 8, 1986 both now abandoned.

BACKGROUND OF THE INVENTION

This invention relates generally to asphalt concrete repair apparatus and more particularly to heating units utilized to soften areas of asphalt pavement.

The idea of heating existing asphalt pavement where it lies on the roadway in order to rejuvenate and make repairs is an old one and a good one. It eliminates lifting and trucking the old asphalt away as well as buying all new asphalt concrete to truck in and spread.

A variety of asphalt heating machines have been produced. They have employed direct flame, steam, microwaves, infrared radiation, etc. to convey heat into the road surface. The best machine for this application would quickly and safely provide the heat for the lowest cost.

It was the intent of the inventor to produce an inexpensive and manuverable infrared heating machine that could effectively heat asphalt roadways. Experiments with forcing combustible air and gas mixture through refractory blanket showed that the blanket could be used as an efficient radiant surface burner medium. Its flexibility and lightweight ideally suited it to use in such a machine. The weight was so decreased by its use instead of rigid refractory material that it was possible to handle over 60 square feet of heating surface manually, eliminating the cost and weight of hydraulics or winches. Complete mobility of the heater speeded repairs and allowed them to be done at any angle relative to the plane of the road.

BRIEF DESCRIPTION OF THE DRAWINGS

FIG. 1 is a sideview of a folding asphalt heater in its folded out position as it would be while heating pavement.

FIG. 2 is a sideview of the machine in FIG. 1 midway between folded out and trailering positions.

FIG. 3 is a sideview of the machine in FIG. 1 and FIG. 2 in its trailering position as it would be while in tow.

FIG. 4 is a cross sectional view of the heating element which is incorporated in the folding asphalt heater.

DETAILED DESCRIPTION OF THE PREFERED EMBODIMENT

Figure 1:
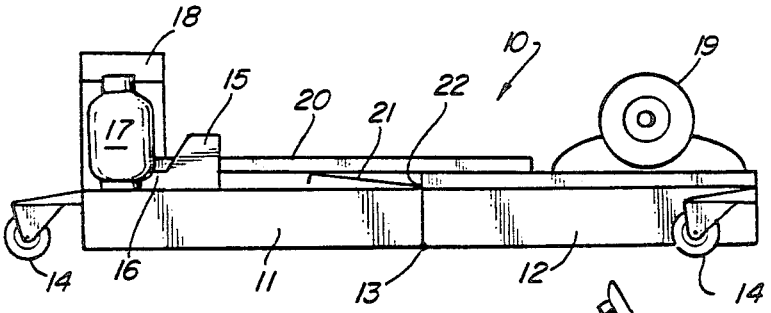
FIG. 1

Referring to FIG. 1 there is seen a side view of a folding asphalt heater that is generally designated by reference number 10. The folding asphalt heater 10 is constructed of first section 11 and second section 12 held together by a first hinge 13 between them. Casters 14 located on each of the four corners of the folding asphalt heater 10 allow manual positioning over the desired areas of pavement.

A blower 15 is run continuously to supply constant pressure air to an air channel 16 which is mounted on the top of section 11. Fuel such as propane is stored in removable tanks 17. The flow of fuel from the tanks into the continuous air stream produced by the blower 15 is regulated by manually operated control valves located in the control panel 18 to produce a combustible mixture.

Figure 2:
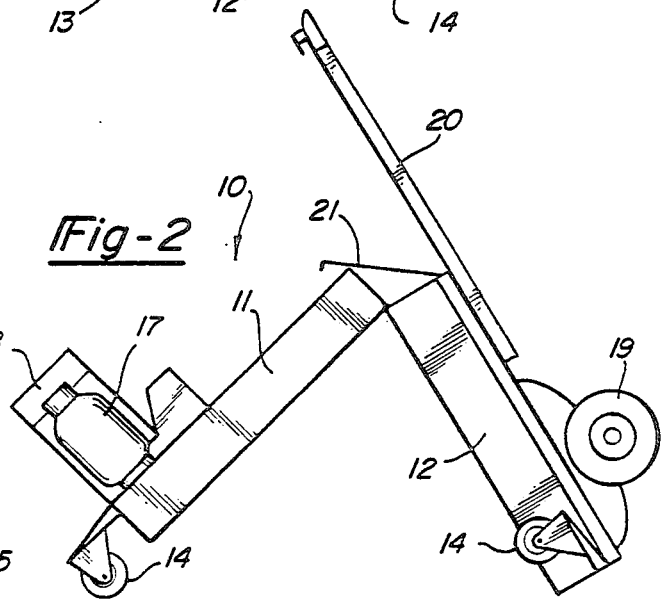
FIG. 2

Two trailer tires 19 and a trailer tongue 20 are attached to the top of section 12. A cover 21 is attached by a second hinge 22 to the corner of section 12 and rests on the top of section Referring now to FIG. 2 the hinged middle of the folding asphalt heater 10 has been lifted to make clear the action of its various parts during folding. The trailer tongue 20 is protruding upward and the cover 21 is pivoting at its hinge 22. Section 12 is resting solidly on the ground while section 11 is rolling toward it on its castors 14.

Figure 3:
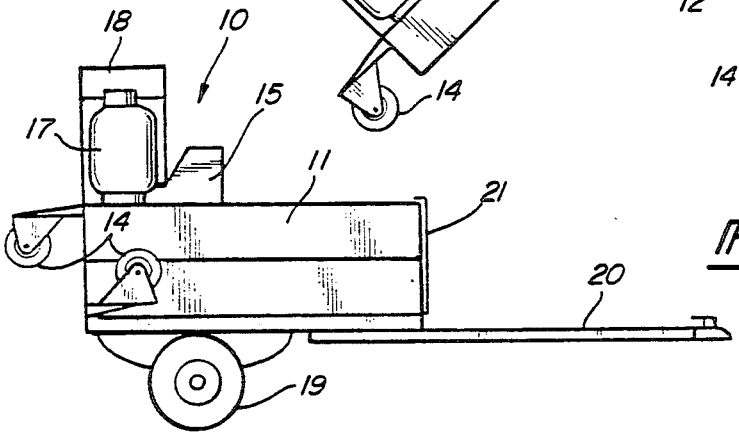
FIG. 3

Referring now to FIG. 3, sections 11 and 12 are together and have their combined weight supported by the trailer tires 19. The cover 21 is in place protecting the hinge ends of sections 11 and 12. The tongue 20 is protruding horizontally to be connected to a tow vehicle.

Figure 4:
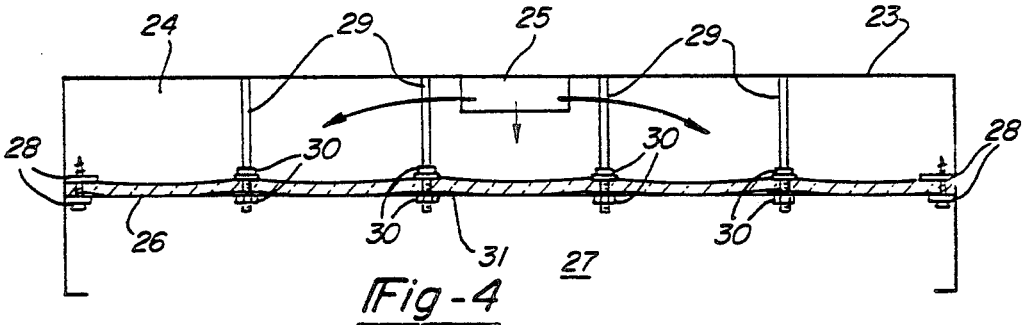
FIG. 4

Referring now to FIG. 4, there is seen a cross section view of either section 11 or 12. The outer shell 23 forms a manifold 24 where fuel/air combustible mixture delivered from the mixing channel 25 is able to flow down and evenly distribute its pressure throughout manifold 24. Ceramic fiber blanket 26 forms the floor of the manifold 24 and the roof of the heating chamber 27. The fuel/air combustible mixture is forced down through the micro spaces between the fibers in the ceramic fiber blanket 26 to be burned across its lower surface, radiating heat downward. The ceramic fiber blanket 26 is squeezed at its perimeter between rigid bars 28 the upper of which is attached to the outer shell 23. This effectively seals the edges of the blanket 26 while holding it in place. Shafts 29 attached to the outer shell 23 extend through the blanket 26. Washers 30 attached to the shafts 29 squeeze and secure the blanket 26 between them. Heat and oxidation resistant nickel alloy wires 31 may be strectched between opposite sides of the lower rigid bars 28 to hold the blanket 26 in place.

What is claimed:

1. A heater for asphalt pavement, comprising:

a two-section heating chamber which overlies the pavement to be heated, said two-section heating chamber including a first section and a second section;

a first hinge for connecting said first section to said second section, said first hinge permitting said first section and said second section to overlie the pavement, said first hinge further permitting said first section to be folded atop said second section when said heater is in a trailered position;

at least one removable fuel tank attached to said first section;

an air channel and a blower connected to said removable fuel tank;

a mixing channel located in each of said first and second sections, said air channel and said blower being connected to said mixing channels, said mixing channels receiving combustible mixtures from said air channel and blower;

said first section and said second section each further comprising an outer shell, each of said shells forming a manifold, said manifolds distributing combustible mixtures from said mixing channels;

a ceramic fiber blanket located adjacent to and beneath each of said manifolds within said shells, said combustible mixtures being forced down through the micro spaces between the fibers in said ceramic fiber blankets to be burned across its lower surface, radiating heat downward;

a pair of trailer tires attached to said second section, said tires extending downward when said first section is folded atop said second section; and a trailer tongue extending from said second section, said tongue permitting said heater to be towed when said sections are folded.

2. The invention as described in claim 1, comprising in addition at least one upper rigid bar and at least one lower rigid bar, said upper and lower rigid bars located at the perimeter of said ceramic fiber blankets, said bars squeezing said blankets therebetween.

3. The invention as described in claim 1, comprising in addition a plurality of shafts attached to said outer shells and extending through said blankets, said shafts securly fastened to said blankets by washers.

4. The invention as described in claim 1, comprising in addition heat and oxidation resistant nickel alloy wires, said wires being stretched between said rigid bars to hold said ceramic fiber blankets in place.

5. The invention as described in claim 1, comprising in addition a cover for protecting the front faces of said first and second sections when in a folded and towable position, said cover being connected by a second hinge located on an edge of said second section.

6. The invention as described in claim 1, comprising in addition castors located in a downwardly facing direction at the four corners of said heater when said heater is operably positioned, said castors permitting said heater to be manually positioned for optimal performance.

7. The invention as described in claim 1, comprising in addition a control panel, said control panel controlling the flow of fuel from said removable fuel tank into the continuous air stream in said air channel.

8. A heater for asphalt pavement comprising:

a shell having a roof, sides, and an open bottom which faces said pavement;

a porous ceramic blanket disposed in said shell dividing the interior of said shell into a manifold located between said porous ceramic blanket and said roof and a heating chamber located between said porous ceramic blanket and said open bottom;

a plurality of rigid bars located on upper and lower sides of said porous ceramic blanket, said rigid bars squeezing said blanket;

a plurality of shafts attached to said shell, said shafts extending through said porous ceramic blanket and said rigid bars to support said porous ceramic blanket;

means for providing a combustible mixture of air and gas into said manifold, said combustible mixture of air and gas flowing from said manifold to said heating chamber through said porous ceramic blanket;

means for manually positioning said heater over a desired area of asphalt pavement; and means for converting said heater from an extended position in which said shell overlies the asphalt pavement to be heated to a folded position in which said heater is easily transported.

9. The invention as described in claim 8, further comprising heat and oxidation resistant wires stretched between opposite sides of said rigid bars on said lower side of said porous ceramic blanket, said wires holding said blanket in place.

* * * * *